US005678411A

United States Patent [19]

Matsumura et al.

[11] Patent Number: 5,678,411

[45] Date of Patent: Oct. 21, 1997

[54] LIQUEFIED GAS SUPPLY SYSTEM

[75] Inventors: Masao Matsumura, Chigasaki; Takao Takeuchi, Tokyo; Tadahiko Kishikawa, Yokohama, all of Japan

[73] Assignee: Ebara Corporation, Tokyo, Japan

[21] Appl. No.: 636,703

[22] Filed: Apr. 23, 1996

[30] Foreign Application Priority Data

Apr. 26, 1995 [JP] Japan ..... 7-125917

[51] Int. Cl.[6] ..... F17C 9/04

[52] U.S. Cl. ..... 62/50.3; 62/50.7

[58] Field of Search ..... 62/50.1, 50.2, 62/50.3, 50.6, 50.7

[56] References Cited

U.S. PATENT DOCUMENTS

| | | | |
|---|---|---|---|
| 2,467,413 | 4/1949 | Wildhack | 62/50.3 |
| 2,799,997 | 7/1957 | Morrison | 62/50.3 |
| 2,964,917 | 12/1960 | Webster | 62/50.3 |
| 3,105,361 | 10/1963 | Bell et al. | 62/50.3 |
| 3,123,983 | 3/1964 | Sliepcevich | 62/50.3 X |
| 3,154,928 | 11/1964 | Harmens | 62/50.3 |
| 3,570,261 | 3/1971 | Schwartzman | 62/50.3 |
| 3,768,271 | 10/1973 | Denis | 62/50.3 |
| 4,178,761 | 12/1979 | Schwartzman | 60/648 |

FOREIGN PATENT DOCUMENTS

| | | | |
|---|---|---|---|
| 0005598 | 1/1983 | Japan | 62/50.3 |
| 0615989 | 2/1980 | Switzerland | 62/50.3 |
| 0624073 | 9/1978 | U.S.S.R. | 62/50.3 |
| 1657898 | 6/1991 | U.S.S.R. | 62/50.3 |

*Primary Examiner*—Christopher Kilner

*Attorney, Agent, or Firm*—Armstrong, Westerman, Hattori, McLeland & Naughton

[57] ABSTRACT

A self-contained liquefied gas supply system has a tank for storing a liquefied gas, a primary pump for delivering the liquefied gas from the tank, a secondary pump for pressurizing the liquefied gas delivered from the primary pump, a vaporizer for vaporizing the liquefied gas discharged from the secondary pump into a vaporized gas, an expander for actuating the secondary pump with the vaporized gas produced by the vaporizer, and a back-pressure line connected to an outlet of the expander. A bypass pipe is connected between the primary pump and the vaporizer in bypassing relation to the secondary pump for supplying the liquefied gas from the primary pump to the vaporizer. A joint line is connected between the back-pressure line and a substantially atmospheric pressure line, the joint line having a first flow regulating valve for regulating a rate of flow of a gas from the back-pressure line to the substantially atmospheric pressure line. A bypass line is connected between the vaporizer and the back-pressure line in bypassing relation to the expander, the bypass line having a second flow regulating mechanism for regulating a rate of flow of the vaporized gas from the vaporizer to the back-pressure line. For starting the secondary pump, the liquefied gas is delivered from the primary pump through the bypass pipe to the vaporizer, which produces a vaporized gas supplied to the expander.

15 Claims, 5 Drawing Sheets

LIQUEFIED GAS SUPPLY SYSTEM

BACKGROUND OF THE INVENTION

1. Field of the Invention

The present invention relates to a liquefied gas supply system having an expander (expansion turbine) pump, suitable for use as equipment for storing, supplying, or consuming a liquefied gas such as a liquefied natural gas or the like, and more particularly to a process of starting an expander pump in such a liquefied gas supply system.

2. Description of the Related Art

FIG. 5 of the accompanying drawings schematically shows a conventional liquefied gas supply system for storing and delivering a liquefied natural gas (LNG). As shown in FIG. 5, the conventional liquefied gas supply system has an underground tank 1 which stores a liquefied natural gas supplied from an LNG tanker. The liquefied natural gas stored in the underground tank 1 is delivered by a primary pump 3 in the underground tank 1 to a secondary pump 5. The liquefied natural gas is then delivered by the secondary pump 5 to vaporizers 4 which convert the liquefied natural gas into a vaporized gas through a heat exchange with seawater or an exhaust gas from a boiler or the like. The vaporizers 4 are supplied with seawater from a pump 2. A liquefied natural gas which is evaporated in the underground tank 1 is a boil-off gas of substantially atmospheric pressure, which is either combusted by a flare stack 8 or pressurized for delivery by a compressor 9.

The vaporized gas produced by the vaporizers 4 is delivered under high pressure through a pipeline to a remote power plant or a consumption site such as a town gas facility.

In the conventional liquefied gas supply system shown in FIG. 5, the secondary pump 5 is powered by an electric motor. Since the secondary pump 5 is a principal pump for delivering the liquefied natural gas under pressure, it handles the liquefied natural gas at a large rate under a high pump head, and hence requires a large amount of horsepower for its operation. Therefore, the electric motor which actuates the secondary pump 5 consumes a large amount of electric energy usually in the range from several hundreds to several thousands kW, and hence needs a high-voltage large-capacity power supply installation.

There has been proposed a self-contained liquefied gas supply system which employs, as a secondary pump, an expander (expansion turbine) pump that can be actuated by a liquefied natural gas which is to be delivered under pressure by the pump itself, so that no energy will not be supplied from an external source for the operation of the pump.

The proposed self-contained liquefied gas supply system operates as follows: A vaporized gas produced by vaporizers is supplied to the expander (expansion turbine) of the expander pump, and is expanded to actuate the expander pump as a secondary pump. A gas which is discharged from the expander has a reduced pressure, and is delivered to a town gas line or supplied as a boiler combustion gas or the like to a consumption site. A gas having a lower pressure is discharged as a boil-off gas to a boil-off gas line, and the boil-off gas is either combusted by a flare stack or pressurized by a boil-off gas compressor for delivery as a combustion gas to a local pipeline or the like.

Use of a self-contained expander pump as a secondary pump in a liquefied gas supply system and structures of such an expander pump are disclosed in detail in Japanese patent applications Nos. 6-139535 and 6-139536.

Under normal operating conditions, the self-contained expander pump as the secondary pump in the liquefied gas supply system can deliver a liquefied natural gas under pressure when the expansion turbine is rotated upon expansion of the high-pressure vaporized gas. However, the self-contained expander pump cannot be started by itself because no high-pressure vaporized gas is available to rotate the expansion turbine at the time of starting the self-contained expander pump.

SUMMARY OF THE INVENTION

It is therefore an object of the present invention to provide a liquefied gas supply system which is capable of smoothly starting a self-contained expander pump by itself without the need for the supply of energy from an external energy source.

According to an aspect of the present invention, there is provided a liquefied gas supply system comprising a tank for storing a liquefied gas, a primary pump for delivering the liquefied gas from the tank, a secondary pump for pressurizing the liquefied gas discharged from the primary pump, a vaporizer for vaporizing the liquefied gas discharged from the secondary pump into a vaporized gas, an expander for actuating the secondary pump with the vaporized gas produced by the vaporizer, a back-pressure line connected to an outlet of the expander, a bypass pipe connected between the primary pump and the vaporizer in bypassing relation to the secondary pump for supplying the liquefied gas from the primary pump to the vaporizer, a substantially atmospheric pressure line, a joint line connected between the back-pressure line and the substantially atmospheric pressure line, the joint line having a first flow regulating mechanism for regulating a rate of flow of a gas from the back-pressure line to the substantially atmospheric pressure line, and a bypass line connected between the vaporizer and the back-pressure line in bypassing relation to the expander, the bypass line having a second flow regulating mechanism for regulating a rate of flow of the vaporized gas from the vaporizer to the back-pressure line. For starting the secondary pump, the liquefied gas may be supplied from the primary pump through the bypass pipe to the vaporizer in bypassing relation to the secondary pump to start the expander. For starting the secondary pump, the back-pressure line may be connected to the substantially atmospheric pressure line through the joint line by the first mechanism to start the expander. For starting the secondary pump, operating the secondary pump in a steady mode, or stopping the secondary pump, the vaporized gas produced by the vaporizer may be delivered, partly or entirely, through the bypass line to the back-pressure line by the second flow regulating mechanism in bypassing relation to the expander. For starting the secondary pump, the first flow regulating mechanism may be closed and the second flow regulating mechanism may be opened when a rotational speed of the secondary pump increases.

According to another aspect of the present invention, there is provided a liquefied gas supply system comprising a tank for storing a liquefied gas, a primary pump for delivering the liquefied gas from the tank, a secondary pump for pressurizing the liquefied gas delivered from the primary pump, a vaporizer for vaporizing the liquefied gas discharged from the secondary pump into a vaporized gas, an expander for actuating the secondary pump with the vaporized gas produced by the vaporizer, a main pipe extending from the primary pump through the secondary pump to the vaporizer, the main pipe having an inlet valve connected to an inlet of the secondary pump and a first flow regulating valve connected to an outlet of the secondary pump for regulating a rate of flow of the liquefied gas from the secondary pump to the vaporizer, a bypass pipe connected between the primary pump and the vaporizer in bypassing relation to the secondary pump for supplying the liquefied gas from the primary pump to the vaporizer, the bypass pipe having a second flow regulating valve for regulating a rate of flow of the liquefied gas from the primary pump to the vaporizer, a back-pressure line connected to an outlet of the expander, the back-pressure line having a third flow regulating valve for regulating a rate of flow of a gas from the expander, a substantially atmospheric pressure line, and a fourth flow regulating valve connected between the back-pressure line and the substantially atmospheric pressure line, for regulating a rate of flow of a gas from the back-pressure line to the substantially atmospheric pressure line, wherein for starting the secondary pump, the inlet valve and the fourth flow regulating valve are opened and the first flow regulating valve is closed, and thereafter the second flow regulating valve is gradually opened to deliver the liquefied gas to the vaporizer and also to supply the vaporized gas from the vaporizer to the expander, and as a rotational speed of the secondary pump increases, the first flow regulating valve is gradually opened and the second flow regulating valve is gradually closed to allow the liquefied gas discharged from the secondary pump to flow as a main liquefied gas flow through the main pipe to the vaporizer, and simultaneously the third flow regulating valve is opened and the fourth flow regulating valve is closed thereby to operate the expander in a steady mode.

For starting the secondary pump in each of the above liquefied gas supply systems, the liquefied gas is delivered from the primary pump through the bypass pipe directly to the vaporizer. The outlet of the expander is kept substantially at the atmospheric pressure, allowing the vaporized gas produced by the vaporizer which is supplied with the liquefied gas delivered from the primary pump under a relatively low pressure to be introduced into the expander. Since the outlet of the expander is kept substantially at the atmospheric pressure, the gas pressure applied to the expander is large enough to start the expander, and the expansion turbine of the expander starts to rotate. When the expander is started, the secondary pump can pressurize the liquefied gas discharged from the primary pump, supplying the liquefied gas to the vaporizer under a progressively higher pressure. The flow regulating valve of the main pipe is gradually opened and the flow regulating valve of the bypass pipe is gradually closed, so that the liquefied gas discharged from the primary pump flows as a main gas flow through the main pipe in steady conditions. The flow regulating valve connected to the substantially atmospheric pressure line is gradually closed and the flow regulating valve of the back-pressure line is gradually opened to operate the expander in a steady mode.

According to still another aspect of the present invention, there is provided a liquefied gas supply system comprising a tank for storing a liquefied gas, a primary pump for delivering the liquefied gas from the tank, a secondary pump for pressurizing the liquefied gas delivered from the primary pump, a vaporizer for vaporizing the liquefied gas discharged from the secondary pump into a vaporized gas, an expander for actuating the secondary pump with the vaporized gas produced by the vaporizer, a back-pressure line connected to an outlet of the expander, an auxiliary pump for delivering a liquefied gas, an auxiliary pipe connected to the vaporizer for supplying the liquefied gas from the auxiliary pump to the vaporizer, a substantially atmospheric pressure line, a joint line connected between the back-pressure line and the substantially atmospheric pressure line, the joint line having a first flow regulating mechanism for regulating a rate of flow of a gas from the back-pressure line to the substantially atmospheric pressure line, and a bypass line connected between the vaporizer and the back-pressure line in bypassing relation to the expander, the bypass line having a second flow regulating mechanism for regulating a rate of flow of the vaporized gas from the vaporizer to the back-pressure line.

For starting the secondary pump in the above liquefied gas supply system, the liquefied gas is delivered from the auxiliary pump to the vaporizer, and the back-pressure line is maintained substantially at the atmospheric pressure, so that the liquefied gas delivered from the auxiliary pump under a relatively low pressure is introduced into the vaporizer. While the pressure of the vaporized gas produced by the vaporizer is relatively low, it is large enough to start the expander because the back-pressure line is maintained substantially at the atmospheric pressure. The expander is started, with the rotational speed of the turbine thereof gradually increasing. The rotational speed of the secondary pump gradually increases, and the secondary pump further pressurizes the liquefied gas delivered from the auxiliary pump, whereupon the pressure of the vaporized gas produced by the vaporizer gradually increases. When the pressure of the vaporized gas increases, the expander produces a higher output, and hence the secondary pump actuated thereby also produces a higher output. As a result, the secondary pump is started.

According to yet still another aspect of the present invention, there is provided a liquefied gas supply system comprising a tank for storing a liquefied gas, a primary pump for delivering the liquefied gas from the tank, a secondary pump for pressurizing the liquefied gas delivered from the primary pump, a vaporizer for vaporizing the liquefied gas discharged from the secondary pump into a vaporized gas, an expander for actuating the secondary pump with the vaporized gas produced by the vaporizer, a back-pressure line connected to an outlet of the expander, an auxiliary pump for delivering a liquefied gas, an auxiliary pipe connected between the tank and the vaporizer in bypassing relation to the secondary pump for supplying the liquefied gas from the tank through the auxiliary pump to the vaporizer, the auxiliary pipe having a first flow regulating mechanism for regulating a rate of flow of the liquefied gas from the tank to the vaporizer, a main pipe connected from the secondary pump to the vaporizer, the main pipe having a second flow regulating mechanism for regulating a rate of flow of the liquefied gas from the secondary pump to the vaporizer, and a bypass line connected between the vaporizer and the back-pressure line in bypassing relation to the expander, the bypass line having a third flow regulating mechanism for regulating a rate of flow of the vaporized gas from the vaporizer to the back-pressure line. For starting the secondary pump, the liquefied gas may be supplied from the auxiliary pump through the auxiliary pipe to the vaporizer in bypassing relation to the secondary pump to start the expander. For starting the secondary pump, operating the secondary pump in a steady mode, or stopping the secondary pump, the vaporized gas produced by the vaporizer may be delivered through the bypass line to the back-pressure line by the third flow regulating mechanism in bypassing relation to the expander. For starting the secondary pump, the first flow regulating mechanism may be closed and the second flow regulating mechanism may be opened when a rotational speed of the secondary pump increases.

According to a further aspect of the present invention, there is also provided a liquefied gas supply system comprising a tank for storing a liquefied gas, a primary pump for delivering the liquefied gas from the tank, a secondary pump for pressurizing the liquefied gas delivered from the primary pump, a vaporizer for vaporizing the liquefied gas discharged from the secondary pump into a vaporized gas, an expander for actuating the secondary pump with the vaporized gas produced by the vaporizer, a back-pressure line connected to an outlet of the expander, an auxiliary pump for delivering a liquefied gas to the vaporizer, an inlet valve connected to an inlet of the auxiliary pump, a first flow regulating valve connected to an outlet of the auxiliary pump, for regulating a rate of flow of the liquefied gas from the auxiliary pump to the vaporizer, and a second flow regulating valve connected to an outlet of the primary pump, for regulating a rate of flow of the liquefied gas from the primary pump to the vaporizer, wherein for starting the secondary pump, the inlet valve and the auxiliary pump are started, and thereafter the first flow regulating valve is gradually opened to deliver the liquefied gas to the vaporizer and also to supply the vaporized gas from the vaporizer to the expander, and as a rotational speed of the secondary pump and a pressure of the liquefied gas discharged from the secondary pump increase, the second flow regulating valve is gradually opened and the first flow regulating valve is closed to allow the liquefied gas discharged from the secondary pump to flow as a main liquefied gas flow to the vaporizer thereby to operate the expander in a steady mode.

For starting the secondary pump in each of the above liquefied gas supply systems, the liquefied gas is delivered from the tank to the vaporizer by the auxiliary pump. The vaporized gas which is produced by the vaporizer is now supplied to the expander to start the expander. The first flow regulating valve is closed and the second flow regulating valve is opened to bring the expander gradually into a steady mode of operation. By regulating the rate of flow of the vaporized gas delivered from the vaporizer to the back-pressure line in bypassing relation to the expander, the vaporized gas can be introduced into the expander at a rate depending on the load on the secondary pump.

According to a still further aspect of the present invention, there is provided a liquefied gas supply system comprising a tank for storing a liquefied gas, a primary pump for delivering the liquefied gas from the tank, a secondary pump for pressurizing the liquefied gas delivered from the primary pump, a vaporizer for vaporizing the liquefied gas discharged from the secondary pump into a vaporized gas, an expander for actuating the secondary pump with the vaporized gas produced by the vaporizer, means for introducing a liquefied gas, other than the liquefied gas delivered from the primary pump, into the vaporizer, a back-pressure line connected to an outlet of the expander, for supplying a gas discharged from the expander to a consumption site, the back-pressure line having a first flow regulating mechanism for regulating a rate of flow of the gas from the expander to the consumption site, a bypass line connected between the vaporizer and the back-pressure line in bypassing relation to the expander, the bypass line having a second flow regulating mechanism for regulating a rate of flow of the vaporized gas from the vaporizer to the back-pressure line, a substantially atmospheric pressure line, and a joint line connected between the back-pressure line and the substantially atmospheric pressure line, the joint line having a third flow regulating mechanism for regulating a rate of flow of the gas from the expander to the substantially atmospheric pressure line.

According to a yet still further aspect of the present invention, there is provided a liquefied gas supply system comprising a tank for storing a liquefied gas, a primary pump for delivering the liquefied gas from the tank, a secondary pump for pressurizing the liquefied gas delivered from the primary pump, a vaporizer for vaporizing the liquefied gas discharged from the secondary pump into a vaporized gas, an expander for actuating the secondary pump with the vaporized gas produced by the vaporizer, means for delivering a vaporized gas, other than the vaporized gas produced by the vaporizer, to the expander, a back-pressure line connected to an outlet of the expander, for supplying a gas discharged from the expander to a consumption site, the back-pressure line having a first flow regulating mechanism for regulating a rate of flow of the gas from the expander to the consumption site, a bypass line connected between the vaporizer and the back-pressure line in bypassing relation to the expander, the bypass line having a second flow regulating mechanism for regulating a rate of flow of the vaporized gas from the vaporizer to the back-pressure line, a substantially atmospheric pressure line, and a point line connected between the back-pressure line and the substantially atmospheric pressure line, the joint line having a first flow regulating mechanism for regulating a rate of flow of the gas from the expander to the substantially atmospheric pressure line.

For starting the secondary pump in each of the above liquefied gas supply systems, a liquefied gas, other than the liquefied gas stored in the tank, is introduced into the vaporizer, or a vaporized gas, other than the vaporized gas produced by the vaporizer, is introduced into the expander, for thereby starting the expander. Since the back-pressure line is connected to the substantially atmospheric pressure line through the first flow regulating mechanism, a gas pressure large enough to start the expander is available even through the pressure at the inlet of the expander is relatively low. When the turbine of the expander starts rotating, and the secondary pump starts operating, the liquefied gas pressurized by the secondary pump is introduced into the vaporizer, and the pressure of the vaporized gas at the outlet of the vaporizer increases. The expander produces a higher output, and hence the secondary pump actuated thereby also produces a higher output. The rotational speed of the secondary pump gradually increases up to a steady rotational speed, and the pressure of the vaporized gas at the outlet of the vaporizer increases. When the first flow regulating mechanism is closed, the gas discharged from the expander is switched from the substantially atmospheric pressure line to a gas delivery line connected to the back-pressure line, and the gas pressure in the gas delivery line increases. The expander now operates in a steady mode. The second flow regulating mechanism can be operated to cause the expander to produce an output depending on the load on the secondary pump, and also to deliver an excessive high-pressure gas directly to the gas delivery line.

According to another aspect of the present invention, there is provided a liquefied gas supply system comprising a tank for storing a liquefied gas, a primary pump for delivering the liquefied gas from the tank, a secondary pump for pressurizing the liquefied gas delivered from the primary pump, a vaporizer for vaporizing the liquefied gas discharged from the secondary pump into a vaporized gas, an expander for actuating the secondary pump with the vaporized gas produced by the vaporizer, a bypass pipe connected between the primary pump and the vaporizer in bypassing relation to the secondary pump for supplying the liquefied gas from the primary pump to the vaporizer, and means for starting the expander with the vaporized gas which is produced by the vaporizer when the liquefied gas is supplied from the primary pump through the bypass pipe to the vaporizer.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
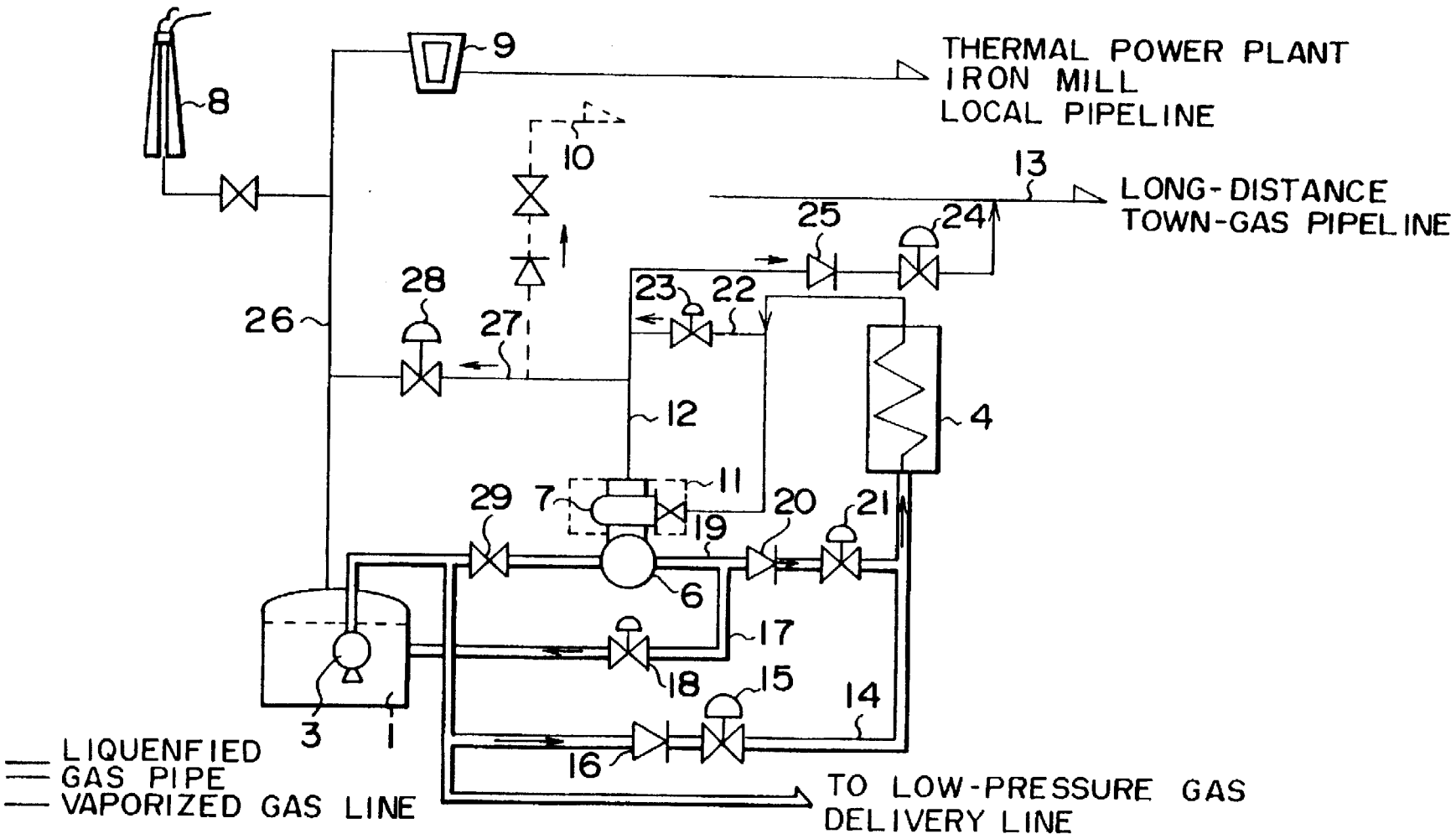
FIG. 1 is a schematic view of a liquefied natural gas supply system according to a first embodiment of the present invention.

Like or corresponding parts are denoted by like or corresponding reference numerals throughout views.

FIG. 1 schematically shows a liquefied natural gas supply system according to a first embodiment of the present invention.

As shown in FIG. 1, the liquefied natural gas supply system has an underground tank 1 which stores a liquefied natural gas that has been transported by an LNG tanker or the like. The liquefied natural gas stored in the underground tank 1 is delivered by a primary pump 3 in the underground tank 1 to a self-contained secondary pump 6 which is actuated by an expander (expansion turbine). The liquefied natural gas is then delivered by the secondary pump 6 to a vaporizer 4. The vaporizer 4 converts the liquefied natural gas into a high-pressure vaporized gas, which is supplied to a pressure regulating governor 11 and regulated in pressure thereby. The pressure-regulated vaporized gas is then expanded in the expander 7 and rotates the impeller of the expansion turbine, thereby actuating the secondary pump 6 which is directly coupled to the expansion turbine.

After having been reduced in pressure by the expansion in the expander 7, the vaporized gas is delivered from a back-pressure line 12 connected to the outlet of the expander 7 through a medium/high-pressure delivery line 13 over a relatively long distance. As described above, the liquefied natural gas delivered from the tank 1 by the pump 3 is gasified by the vaporizer 4, and the secondary pump 6 is actuated by the expander 7 under the pressure of the vaporized gas from the vaporizer 4. Therefore, discharged gases are delivered under various pressures from the expander 7 through the delivery line 13, a delivery line 10, and a boil-off gas line 26 (described later on). The gas delivered through the delivery line 13 has a relatively high pressure ranging from 30 to 70 kg/cm$^2$ and is supplied over a relatively long distance as a town gas or the like to a pipeline or the like. The gas delivered through the boil-off gas line 26 has a relatively low pressure of about 10 kg/cm$^2$ and is supplied over a relatively short distance as a town gas or a fuel to a thermal power plant, an iron mill, a local pipeline, or the like.

The liquefied natural gas supply system has various measuring units and a controller (not shown) for operating the entire system in an optimum mode.

The liquefied natural gas supply system has pipes and lines, described below, for starting the self-contained secondary pump 6. The liquefied natural gas flows through the pipes, and the vaporized gas flows through the pipes. A bypass pipe 14 bypasses the secondary pump 6 for supplying the liquefied natural gas from the primary pump 3 directly to the vaporizer 4. The pipe 14 has a flow regulating valve 15 which can be opened and closed to regulate the rate of flow of the liquefied natural gas and a check valve 16 which prevents the liquefied natural gas from flowing back. A minimum-flow circulation pipe 17 is connected to the outlet of the secondary pump 6 and extends through a flow regulating valve 18 to the tank 1. The minimum-flow circulation pipe 17 serves to prevent the liquefied natural gas from being overheated in the secondary pump 6 upon shut-off operation thereof, and allows a minimum flow of liquefied natural gas to pass through the secondary pump 6 in shut-off operation thereof.

The secondary pump 6 is connected in a main pipe 19 extending from the tank 1 to the vaporizer 4. The main pipe 19 has an inlet valve 29 connected to the inlet of the secondary pump 6, and a check valve 20 and a flow regulating valve 21 which are connected to the outlet of the secondary pump 6. The main pipe 19 extending from the outlet of the flow regulating valve 21 is joined to the bypass pipe 14 and connected to the inlet of the vaporizer 4.

From the outlet of the vaporizer 4, there extends a gas line connected to the pressure regulating governor 11 and branched into a bypass line 22 which is connected directly to the back-pressure line 12 in bypassing relation to the expander 7. The bypass line 22 has a flow regulating valve 23 for regulating the rate of flow of the vaporized gas. The back-pressure line 12 has a flow regulating valve 24 and a check valve 25. To the back-pressure line 12, there is connected a joint line 27 vented substantially to the atmosphere through a boil-off gas line 26 connected to the tank 1 and a flare stack 8. The joint line 27 has a flow regulating valve 28. The boil-off gas line 26 is connected to a boil-off gas compressor 9.

The flow regulating valves 15, 18, 21, 23, 24, 28 are controlled for their opening and closing by the controller (not shown) to control the rate of flow of the liquefied natural gas in the pipes and the vaporized gas in the lines.

A process of starting the secondary pump 6 will be described below. The liquefied natural gas is stored in the underground tank 1, and is delivered from the underground tank 1 by the primary pump 3.

First, the inlet valve 29 and the flow regulating valve 18 are opened to produce a minimum flow of liquefied natural gas through the secondary pump 6. At this time, the regulating valve 21 is closed. The flow regulating valve 15 is gradually opened to deliver the liquefied natural gas under pressure from the primary pump 3 through the bypass pipe 14 to the vaporizer 4 in bypassing relation to the secondary pump 6. The vaporizer 4 vaporizes the supplied liquefied natural gas through a heat exchange, and discharges a vaporized gas under high pressure.

The flow regulating valves 23, 24 are closed and the flow regulating valve 28 is opened. Therefore, all the vaporized gas discharged from the vaporizer 4 is directed to the expander 7.

The vaporized gas discharged from the vaporizer 4 flows through the pressure regulating governor 11 into the expander 7 in which it expands to start the secondary pump 6. Since the flow regulating valve 28 is open, the back-pressure line 12 is connected to the boil-off gas line 26. While the pressure of the gas at the inlet of the expander 7 is low upon starting of the secondary pump 6, the expander 7 is supplied with a gas pressure large enough to start the secondary pump 6 because the pressure in the back-pressure line 12 is substantially the atmospheric pressure.

As the vaporized gas is continuously supplied to the expander 7, the rotational speed of the secondary pump 6 gradually increases, and hence the pressure of the liquefied natural gas discharged from the secondary pump 6 also gradually increases. The flow regulating valve 21 is now gradually opened, whereupon the rate of flow of the liquefied natural gas through the main pipe 19 gradually increases, so that the flow of the liquefied natural gas through the main pipe 19 becomes a main flow. Concurrently, the flow regulating valve 15 is gradually closed. The secondary pump 6 has now been completely started, and operates under steady conditions.

At the same time, the flow regulating valve 28 is gradually closed and the flow regulating valve 24 is gradually opened in proportion to the rotational speed of the turbine of the expander 7. Simultaneously, the opening of the flow regulating valve 23 is adjusted to supply the vaporized gas under a predetermined pressure to the pressure regulating governor 11. In this manner, when the secondary pump 6 is started and as its rotational speed approaches an appropriate value, the flow regulating valve 28 is gradually closed to limit the rate of flow of the vaporized gas discharged into the boil-off gas line 26, and the flow regulating valve 24 is gradually opened to bring the expander 7 smoothly into a steady mode of operation. At the time the secondary pump 6 is started, the amount of the vaporized gas which enters the expander 7 increases. However, the flow regulating valve 23 is opened to allow the vaporized gas to flow into the back-pressure line 12 in bypassing relation to the expander 7. As a consequence, the vaporized gas which would otherwise excessively be supplied to the expander 7 is controlled by the flow regulating valve 23 to permit the secondary pump 6 to start smoothly.

As described above, when the secondary pump 6 is started, since the liquefied natural gas is delivered from the primary pump 3 directly to the vaporizer 4 in bypassing relation to the secondary pump 4, the vaporizer 4 can supply a vaporized gas for starting the expander 7 without suffering a large pressure loss caused by the secondary pump 6. Inasmuch as the outlet of the expander 7 is maintained substantially at the atmospheric pressure, it is possible to supply the expander 7 with a vaporized gas pressure large enough to start the secondary pump 6 even though the vaporized gas pressure at the inlet of the expander 7 is of a relatively low value, which is usually 10 kg/cm$^2$, equal to the pressure of the liquefied natural gas discharged from the primary pump 3. The bypass line 22 which bypasses the expander 7 is effective to regulate the rate of flow of the vaporized gas which enters the expander 7 for thereby adjusting the output power of the expander 7. If the outlet of the expander 7 remained substantially at the atmospheric pressure after the primary pump 6 is started, then the pressure of the vaporized gas in the expander 7 would be too high to operate the secondary pump 6 normally. However, because the flow regulating valve 28 is gradually closed and the flow regulating valve 24 is gradually opened to deliver the vaporized gas toward the delivery line 13, the pressure discharged from the outlet of the expander 7 is controlled at a suitable pressure to bring the expander 7 smoothly into a steady mode of operation. The liquefied natural gas supply system is a resource saver as well as an energy saver because the secondary pump 6 can be started by itself without the need for the supply of energy from an external energy source.

Figure 2:
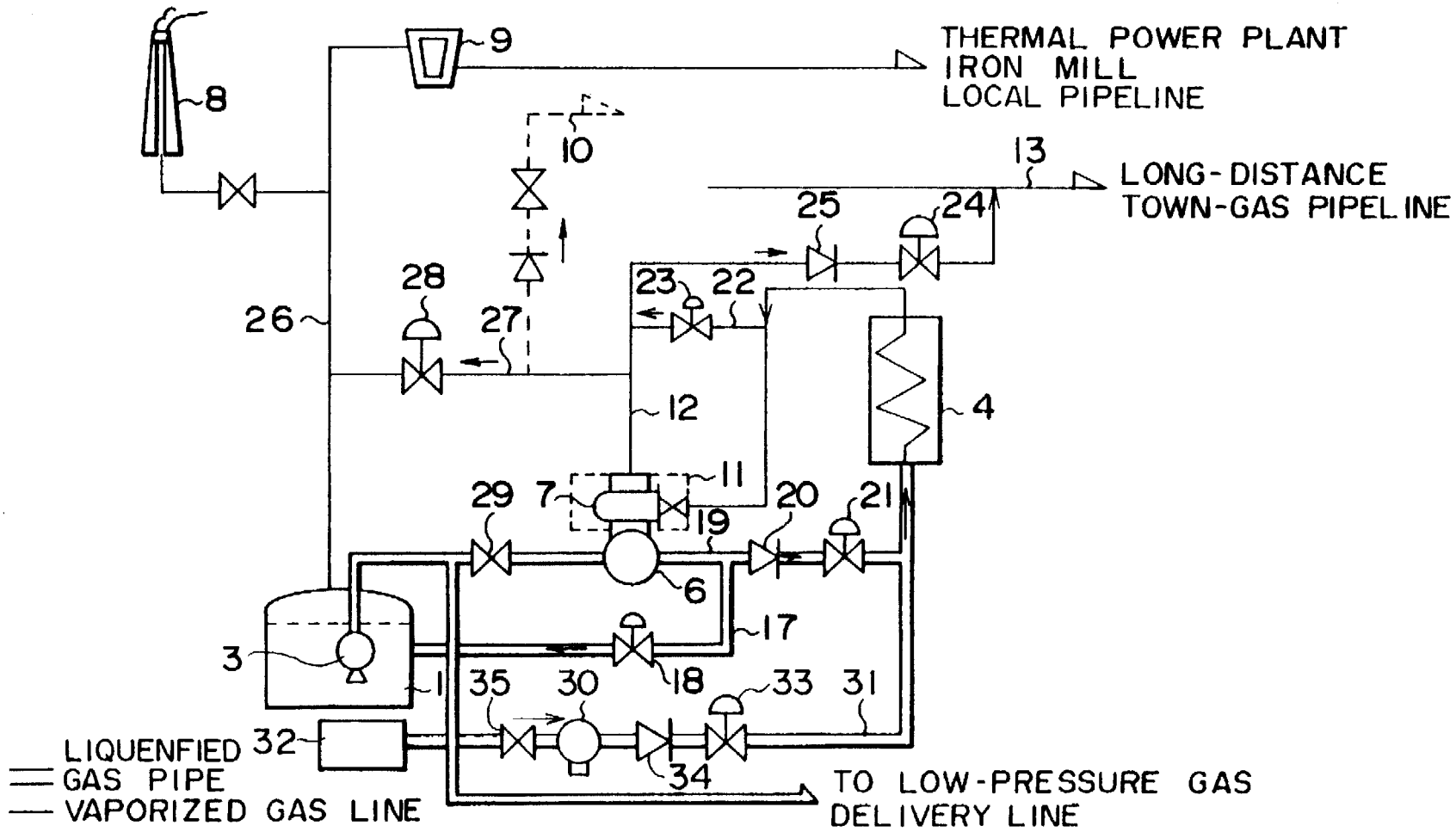
FIG. 2 is a schematic view of a liquefied natural gas supply system according to a second embodiment of the present invention.

FIG. 2 schematically shows a liquefied natural gas supply system according to a second embodiment of the present invention. The liquefied natural gas supply system according to the second embodiment has a basic structure which is the same as that of the liquefied natural gas supply system according to the first embodiment. Those parts of the liquefied natural gas supply system shown in FIG. 2 which are identical to those of the liquefied natural gas supply system shown in FIG. 1 are denoted by identical reference numerals, and will not be described in detail below.

The liquefied natural gas supply system according to the second embodiment differs from the liquefied natural gas supply system according to the first embodiment in that, instead of the bypass pipe 14 shown in FIG. 1, an auxiliary pipe 31 connected to a tank 32 and having a motor-driven auxiliary pump 30 is joined to the main pipe 19 and coupled to the inlet of the vaporizer 4. The auxiliary pump 30 serves to deliver a liquefied natural gas from the tank 32 through the auxiliary pipe 31 to the vaporizer 4. The auxiliary pipe 31 has a flow regulating valve 33, a check valve 34, and an inlet valve 35.

To start the secondary pump 6 in the liquefied natural gas supply system according to the second embodiment, the inlet valve 35 is opened and the auxiliary pump 30 is operated. The flow regulating valve 33 is gradually opened to deliver the liquefied natural gas from the tank 32 through the auxiliary pipe 31 to the vaporizer 4. Because the outlet of the expander 7 is connected to the boil-off gas line 26 and hence is maintained substantially at the atmospheric pressure, it is possible to supply the expander 7 with a vaporized gas pressure large enough to start the secondary pump 6 even though the vaporized gas pressure is produced from the liquefied natural gas delivered by the auxiliary pump 30 which is of a relatively small capacity. When the expander 7 starts operating, the secondary pump 6 starts to operate, delivering the liquefied natural gas from the tank 1 through the main pipe 19 to the vaporizer 4 through the flow regulating valve 21 which is gradually opened. The pressure of the vaporized gas at the outlet of the vaporizer 4 increases, thereby increasing the pressure of the vaporized gas in the expander 7. The pressure of the liquefied natural gas discharged by the secondary pump 6 also increases, thereby bringing the expander 7 and the secondary pump 6 into a steady mode of operation. At the same time, the flow regulating valve 33 is gradually closed. The flow regulating valve 28 is gradually closed and the flow regulating valve 24 is gradually opened to deliver the vaporized gas discharged from the expander 7 through the delivery line 13 to the pipeline over the long distance. The opening of the flow regulating valve 23 is adjusted to supply the vaporized gas under a predetermined pressure, which is required for the expander 7 to operate the secondary pump 6, to the pressure regulating governor 11.

Figure 3:
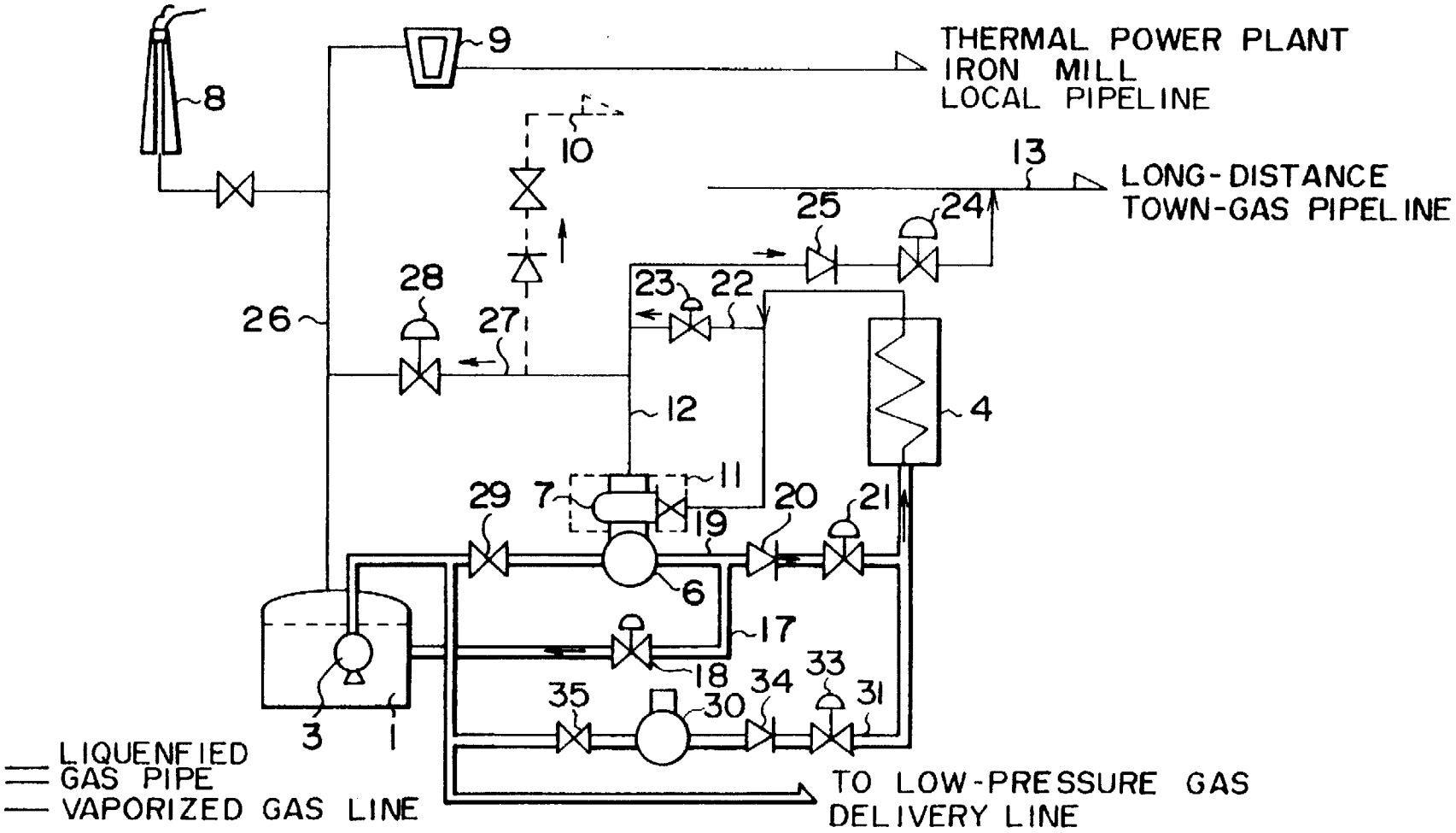
FIG. 3 is a schematic view of a liquefied natural gas supply system according to a third embodiment of the present invention.

FIG. 3 schematically shows a liquefied natural gas supply system according to a third embodiment of the present invention. The liquefied natural gas supply system according to the third embodiment has a basic structure which is the same as that of the liquefied natural gas supply system according to the second embodiment. Those parts of the liquefied natural gas supply system shown in FIG. 3 which are identical to those of the liquefied natural gas supply system shown in FIG. 2 are denoted by identical reference numerals, and will not be described in detail below.

The liquefied natural gas supply system according to the third embodiment differs from the liquefied natural gas supply system according to the second embodiment in that the tank 32 shown in FIG. 2 is dispensed with, and the auxiliary pump 30 delivers the liquefied natural gas from the tank 1 through the auxiliary pipe 31 to the vaporizer 4. The secondary pump 6 in the liquefied natural gas supply system according to the third embodiment can be started in the same manner as the secondary pump 6 in the liquefied natural gas supply system according to the second embodiment.

Figure 4:
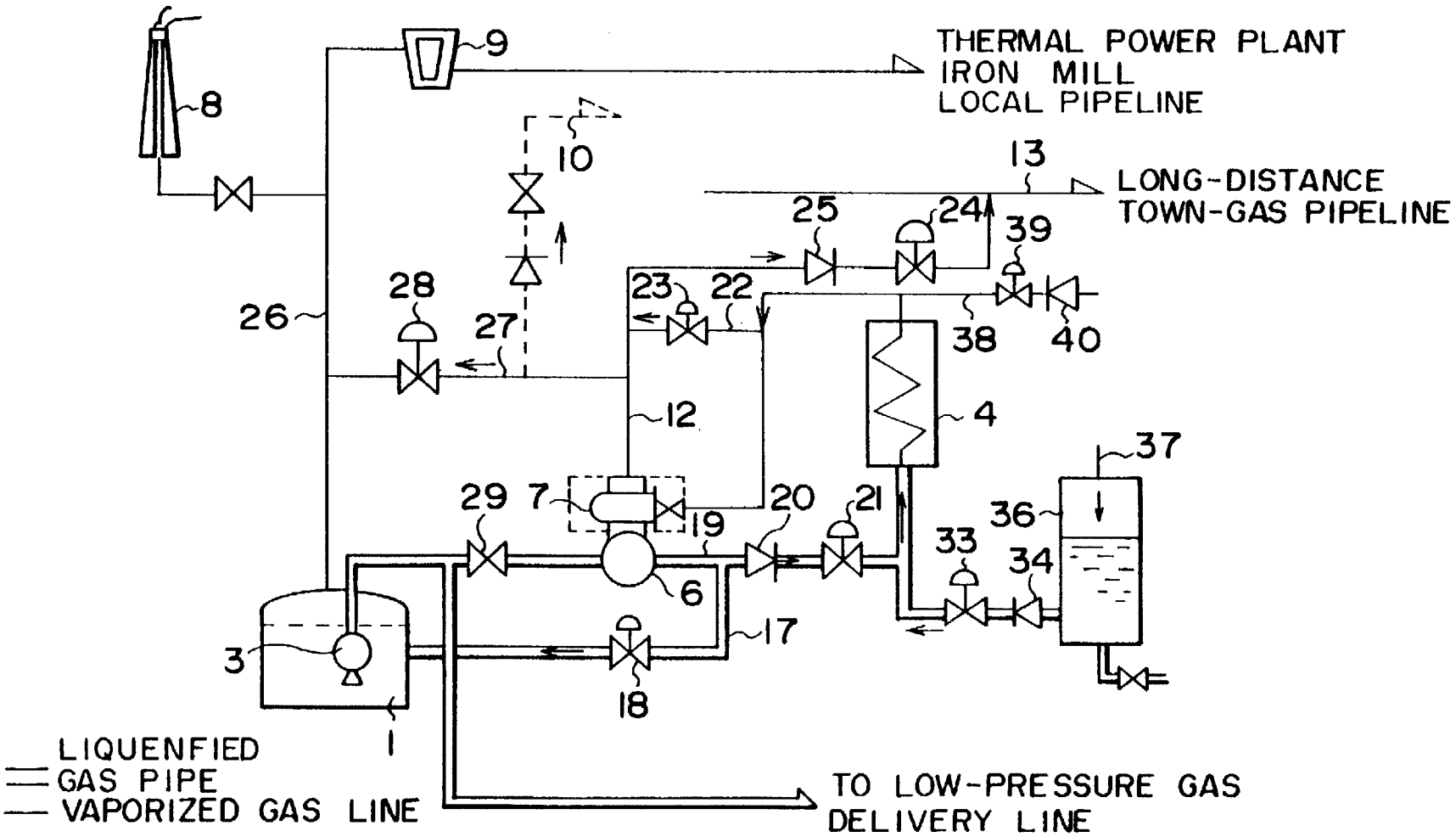
FIG. 4 is a schematic view of a liquefied natural gas supply system according to a fourth embodiment of the present invention.
Figure 5:
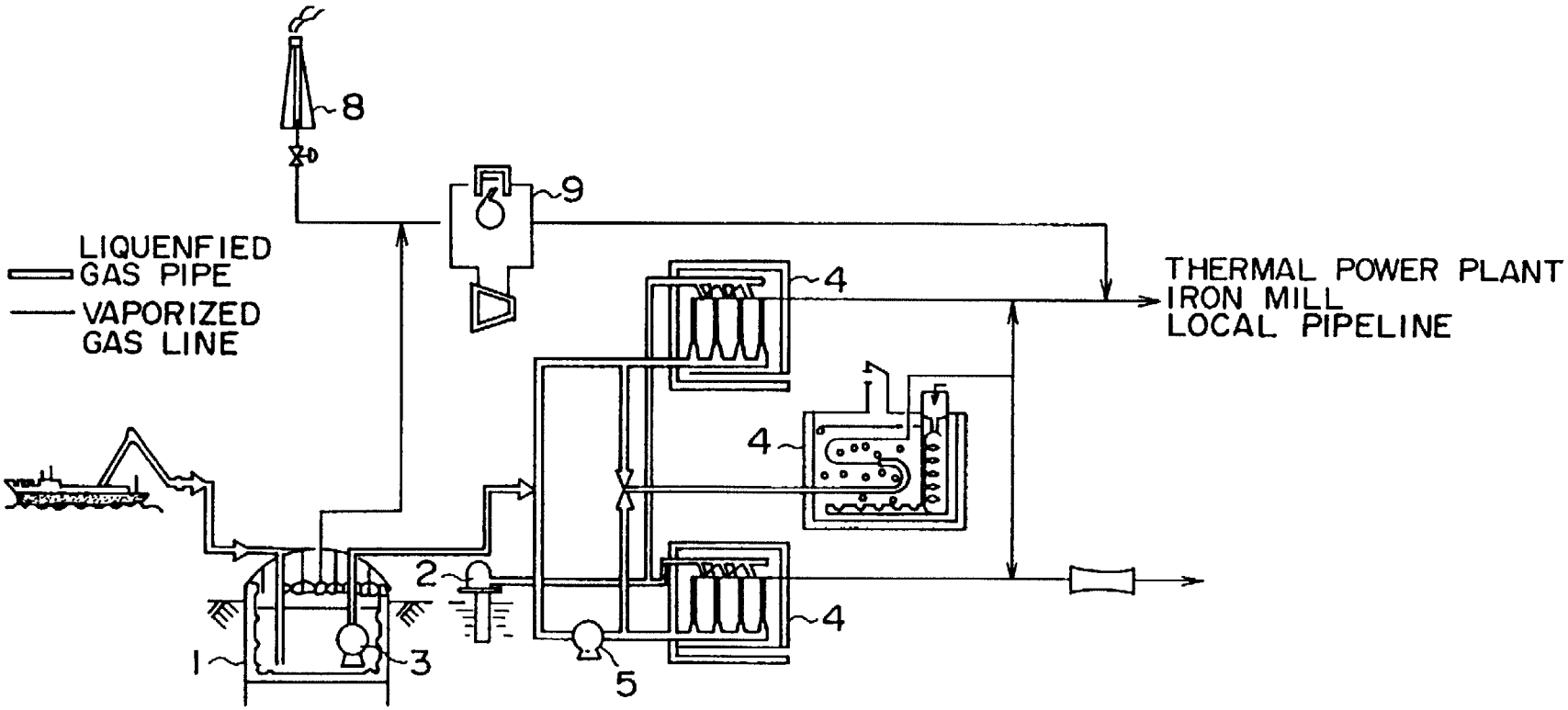
FIG. 5 PRIOR ART
FIG. 5 is a schematic view of a conventional liquefied natural gas supply system.

FIG. 4 schematically shows a liquefied natural gas supply system according to a fourth embodiment of the present invention. The liquefied natural gas supply system according to the fourth embodiment has a basic structure which is the same as that of the liquefied natural gas supply system according to the second embodiment. Those parts of the liquefied natural gas supply system shown in FIG. 4 which are identical to those of the liquefied natural gas supply system shown in FIG. 2 are denoted by identical reference numerals, and will not be described in detail below.

The liquefied natural gas supply system according to the fourth embodiment differs from the liquefied natural gas supply system according to the second embodiment in that the auxiliary pipe 31 is connected to a tank 36 for delivering a pressurized liquefied natural gas from the tank 36 to the vaporizer 4. The auxiliary pipe 31 has the flow regulating valve 33 and the check valve 34. The pressurized liquefied natural gas is supplied from the tank 36 to the auxiliary pipe 31 by applying a pressurized gas to the gas level in the tank 36 from an inlet port 37. The pressurized gas may be either a gas produced by vaporizing the liquefied natural gas which is handled by the liquefied natural gas supply system, or any of various other gases. The secondary pump 6 in the liquefied natural gas supply system according to the fourth embodiment can be started in the same manner as the secondary pump 6 in the liquefied natural gas supply system according to the second embodiment.

In FIG. 4, a pipe 38 having a flow regulating valve 39 and a check valve 40 may be connected to the outlet of the vaporizer 4 for supplying a vaporized gas from another pressurized gas source.

If the vaporized gas can be supplied from the auxiliary pipe 31 through the vaporizer 4 or from the auxiliary pipe 38 under a pressure large enough to start the secondary pump 6, then the outlet of the expander 7 may not necessarily be maintained at the atmospheric pressure. In such a case, the joint line 27 with the flow regulating valve 28 may be dispensed with, simplifying the liquefied natural gas supply system.

While the present invention has been illustrated as being embodied in liquefied natural gas supply systems, the principles of the present invention are also applicable to liquefied gas supply systems for supplying other liquefied gases such as a liquefied propane gas (LPG) or the like.

Although certain preferred embodiments of the present invention have been shown and described in detail, it should be understood that various changes and modifications may be made therein without departing from the scope of the appended claims.

What is claimed is:

1. A liquefied gas supply system comprising:

a tank for storing a liquefied gas;

a primary pump for delivering the liquefied gas from said tank;

a secondary pump for pressurizing the liquefied gas delivered from said primary pump;

a vaporizer for vaporizing the liquefied gas discharged from said secondary pump into a vaporized gas;

an expander for actuating said secondary pump with the vaporized gas produced by said vaporizer;

a back-pressure line connected to an outlet of said expander;

a bypass pipe connected between said primary pump and said vaporizer in bypassing relation to said secondary pump for supplying the liquefied gas from said primary pump to said vaporizer;

a substantially atmospheric pressure line;

a joint line connected between said back-pressure line and said substantially atmospheric pressure line, said joint line having a first flow regulating mechanism for regulating a rate of flow of a gas from said back-pressure line to said substantially atmospheric pressure line; and a bypass line connected between said vaporizer and said back-pressure line in bypassing relation to said expander, said bypass line having a second flow regulating mechanism for regulating a rate of flow of the vaporized gas from said vaporizer to said back-pressure line.

2. A liquefied gas supply system according to claim 1, wherein for starting said secondary pump, the liquefied gas is supplied from said primary pump through said bypass pipe to said vaporizer in bypassing relation to said secondary pump to start said expander.

3. A liquefied gas supply system according to claim 1, wherein for starting said secondary pump, said back-pressure line is connected to said substantially atmospheric pressure line through said joint line to start said expander.

4. A liquefied gas supply system according to claim 1, wherein for starting said secondary pump, operating said secondary pump in a steady mode, or stopping said secondary pump, the vaporized gas produced by said vaporizer is delivered, through said bypass line to said back-pressure line in bypassing relation to said expander.

5. A liquefied gas supply system according to claim 1, wherein for starting said secondary pump, said first flow regulating mechanism is closed and said second flow regulating mechanism is opened when a rotational speed of said secondary pump increases.

6. A liquefied gas supply system comprising:

a tank for storing a liquefied gas;

a primary pump for delivering the liquefied gas from said tank;

a secondary pump for pressurizing the liquefied gas delivered from said primary pump;

a vaporizer for vaporizing the liquefied gas discharged from said secondary pump into a vaporized gas;

an expander for actuating said secondary pump with the vaporized gas produced by said vaporizer;

a main pipe extending from said primary pump through said secondary pump to said vaporizer, said main pipe having an inlet valve connected to an inlet of said secondary pump and a first flow regulating valve connected to an outlet of said secondary pump for regulating a rate of flow of the liquefied gas from said secondary pump to said vaporizer;

a bypass pipe connected between said primary pump and said vaporizer in bypassing relation to said secondary pump for supplying the liquefied gas from said primary pump to said vaporizer, said bypass pipe having a second flow regulating valve for regulating a rate of flow of the liquefied gas from said primary pump to said vaporizer;

a back-pressure line connected to an outlet of said expander, said back-pressure line having a third flow regulating valve for regulating a rate of flow of a gas from said expander;

a substantially atmospheric pressure line; and a fourth flow regulating valve connected between said back-pressure line and said substantially atmospheric pressure line, for regulating a rate of flow of a gas from said back-pressure line to said substantially atmospheric pressure line;

wherein for starting said secondary pump, said inlet valve and said fourth flow regulating valve are opened and said first flow regulating valve is closed, and thereafter said second flow regulating valve is gradually opened to deliver the liquefied gas to said vaporizer and also to supply the vaporized gas from said vaporizer to said expander, and as a rotational speed of said secondary pump increases, said first flow regulating valve is gradually opened and said second flow regulating valve is gradually closed to allow the liquefied gas discharged from said secondary pump to flow as a main liquefied gas flow through said main pipe to said vaporizer, and simultaneously said third flow regulating valve is opened and said fourth flow regulating valve is closed thereby to operate said expander in a steady mode.

7. A liquefied gas supply system comprising:

a tank for storing a liquefied gas;

a primary pump for delivering the liquefied gas from said tank;

a secondary pump for pressurizing the liquefied gas delivered from said primary pump;

a vaporizer for vaporizing the liquefied gas discharged from said secondary pump into a vaporized gas;

an expander for actuating said secondary pump with the vaporized gas produced by said vaporizer;

a back-pressure line connected to an outlet of said expander;

an auxiliary pump for delivering a liquefied gas;

an auxiliary pipe connected to said vaporizer for supplying the liquefied gas from said auxiliary pump to said vaporizer;

a substantially atmospheric pressure line;

a joint line connected between said back-pressure line and said substantially atmospheric pressure line, said joint line having a first flow regulating mechanism for regulating a rate of flow of a gas from said back-pressure line to said substantially atmospheric pressure line; and a bypass line connected between said vaporizer and said back-pressure line in bypassing relation to said expander, said bypass line having a second flow regulating mechanism for regulating a rate of flow of the vaporized gas from said vaporizer to said back-pressure line.

8. A liquefied gas supply system comprising:

a tank for storing a liquefied gas;

a primary pump for delivering the liquefied gas from said tank;

a secondary pump for pressurizing the liquefied gas delivered from said primary pump;

a vaporizer for vaporizing the liquefied gas discharged from said secondary pump into a vaporized gas;

an expander for actuating said secondary pump with the vaporized gas produced by said vaporizer;

a back-pressure line connected to an outlet of said expander;

an auxiliary pump for delivering a liquefied gas;

an auxiliary pipe connected between said tank and said vaporizer in bypassing relation to said secondary pump for supplying the liquefied gas from said tank through said auxiliary pump to said vaporizer, said auxiliary pipe having a first flow regulating mechanism for regulating a rate of flow of the liquefied gas from said tank to said vaporizer;

a main pipe connected from said secondary pump to said vaporizer, said main pipe having a second flow regulating mechanism for regulating a rate of flow of the liquefied gas from said secondary pump to said vaporizer; and a bypass line connected between said vaporizer and said back-pressure line in bypassing relation to said expander, said bypass line having a third flow regulating mechanism for regulating a rate of flow of the vaporized gas from said vaporizer to said back-pressure line.

9. A liquefied gas supply system according to claim 8, wherein for starting said secondary pump, the liquefied gas is supplied from said auxiliary pump through said auxiliary pipe to said vaporizer in bypassing relation to said secondary pump to start said expander.

10. A liquefied gas supply system according to claim 8, wherein for starting said secondary pump, operating said secondary pump in a steady mode, or stopping said secondary pump, the vaporized gas produced by said vaporizer is delivered through said bypass line to said back-pressure line by said third flow regulating mechanism in bypassing relation to said expander.

11. A liquefied gas supply system according to claim 8, wherein for starting said secondary pump, said first flow regulating mechanism is closed and said second flow regulating mechanism is opened when a rotational speed of said secondary pump increases.

12. A liquefied gas supply system comprising:

a tank for storing a liquefied gas;

a primary pump for delivering the liquefied gas from said tank;

a secondary pump for pressurizing the liquefied gas delivered from said primary pump;

a vaporizer for vaporizing the liquefied gas discharged from said secondary pump into a vaporized gas;

an expander for actuating said secondary pump with the vaporized gas produced by said vaporizer;

a back-pressure line connected to an outlet of said expander;

an auxiliary pump for delivering a liquefied gas to said vaporizer;

an inlet valve connected to an inlet of said auxiliary pump;

a first flow regulating valve connected to an outlet of said auxiliary pump, for regulating a rate of flow of the liquefied gas from said auxiliary pump to said vaporizer; and a second flow regulating valve connected to an outlet of said primary pump, for regulating a rate of flow of the liquefied gas from said primary pump to said vaporizer;

wherein for starting said secondary pump, said inlet valve and said auxiliary pump are started, and thereafter said first flow regulating valve is gradually opened to deliver the liquefied gas to said vaporizer and also to supply the vaporized gas from said vaporizer to said expander, and as a rotational speed of said secondary pump and a pressure of the liquefied gas discharged from said secondary pump increase, said second flow regulating valve is gradually opened and said first flow regulating valve is closed to allow the liquefied gas discharged from said secondary pump to flow as a main liquefied gas flow to said vaporizer thereby to operate said expander in a steady mode.

13. A liquefied gas supply system comprising:

a tank for storing a liquefied gas;

a primary pump for delivering the liquefied gas from said tank;

a secondary pump for pressurizing the liquefied gas delivered from said primary pump;

a vaporizer for vaporizing the liquefied gas discharged from said secondary pump into a vaporized gas;

an expander for actuating said secondary pump with the vaporized gas produced by said vaporizer;

means for introducing a liquefied gas, other than the liquefied gas delivered from said primary pump, into said vaporizer;

a back-pressure line connected to an outlet of said expander, for supplying a gas discharged from said expander to a consumption site, said back-pressure line having a first flow regulating mechanism for regulating a rate of flow of the gas from said expander to the consumption site;

a bypass line connected between said vaporizer and said back-pressure line in bypassing relation to said expander, said bypass line having a second flow regulating mechanism for regulating a rate of flow of the vaporized gas from said vaporizer to said back-pressure line;

a substantially atmospheric pressure line; and a joint line connected between said back-pressure line and said substantially atmospheric pressure line, said joint line having a third flow regulating mechanism for regulating a rate of flow of the gas from said expander to said substantially atmospheric pressure line.

14. A liquefied gas supply system comprising:

a tank for storing a liquefied gas;

a primary pump for delivering the liquefied gas from said tank;

a secondary pump for pressurizing the liquefied gas delivered from said primary pump;

a vaporizer for vaporizing the liquefied gas discharged from said secondary pump into a vaporized gas;

an expander for actuating said secondary pump with the vaporized gas produced by said vaporizer;

means for delivering a vaporized gas, other than the vaporized gas produced by said vaporizer, to said expander;

a back-pressure line connected to an outlet of said expander, for supplying a gas discharged from said expander to a consumption site, said back-pressure line having a first flow regulating mechanism for regulating a rate of flow of the gas from said expander to the consumption site;

a bypass line connected between said vaporizer and said back-pressure line in bypassing relation to said expander, said bypass line having a second flow regulating mechanism for regulating a rate of flow of the vaporized gas from said vaporizer to said back-pressure line;

a substantially atmospheric pressure line; and a joint line connected between said back-pressure line and said substantially atmospheric pressure line, said joint line having a third flow regulating mechanism for regulating a rate of flow of the gas from said expander to said substantially atmospheric pressure line.

15. A liquefied gas supply system comprising:

a tank for storing a liquefied gas;

a primary pump for delivering the liquefied gas from said tank;

a secondary pump for pressurizing the liquefied gas delivered from said primary pump;

a vaporizer for vaporizing the liquefied gas discharged from said secondary pump into a vaporized gas;

an expander for actuating said secondary pump with the vaporized gas produced by said vaporizer;

a bypass pipe connected between said primary pump and said vaporizer in bypassing relation to said secondary pump for supplying the liquefied gas from said primary pump to said vaporizer; and means for starting said expander with the vaporized gas which is produced by said vaporizer when the liquefied gas is supplied from said primary pump through said bypass pipe to said vaporizer.

* * * * *